US009058821B2

(12) United States Patent
Matsumoto et al.

(10) Patent No.: US 9,058,821 B2
(45) Date of Patent: Jun. 16, 2015

(54) COMPUTER-READABLE MEDIUM FOR RECORDING AUDIO SIGNAL PROCESSING ESTIMATING A SELECTED FREQUENCY BY COMPARISON OF VOICE AND NOISE FRAME LEVELS

(75) Inventors: Chikako Matsumoto, Kawasaki (JP); Naoshi Matsuo, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 1460 days.

(21) Appl. No.: 12/621,918

(22) Filed: Nov. 19, 2009

(65) Prior Publication Data

US 2010/0138220 A1 Jun. 3, 2010

(30) Foreign Application Priority Data

Nov. 28, 2008 (JP) ..... 2008-304394

(51) Int. Cl.

| | |
|---|---|
| ***G10L 21/00*** | (2013.01) |
| ***G10L 25/69*** | (2013.01) |
| ***G10L 21/0208*** | (2013.01) |
| *G10L 19/005* | (2013.01) |
| *G10L 19/12* | (2013.01) |
| *G10L 21/02* | (2013.01) |

(52) U.S. Cl.

CPC ..... *G10L 25/69* (2013.01); *G10L 19/005* (2013.01); *G10L 21/0208* (2013.01); *G10L 19/12* (2013.01); *G10L 21/02* (2013.01)

(58) Field of Classification Search

CPC ..... G10L 21/0208; G10L 25/278
USPC ..... 704/226, 219
See application file for complete search history.

(56) References Cited

U.S. PATENT DOCUMENTS

| | | | | |
|---|---|---|---|---|
| 2005/0240401 | A1* | 10/2005 | Ebenezer | 704/226 |
| 2007/0033015 | A1* | 2/2007 | Taira et al. | 704/219 |
| 2009/0138260 | A1* | 5/2009 | Terao | 704/219 |

FOREIGN PATENT DOCUMENTS

| | | | |
|---|---|---|---|
| JP | H07-84596 | A | 3/1995 |
| JP | 2001-309483 | A | 11/2001 |
| JP | 2005-77885 | A | 3/2005 |
| JP | 2006-243504 | A | 9/2006 |
| JP | 2008-15443 | A | 1/2008 |
| WO | WO-2007/005875 | A1 | 1/2007 |

OTHER PUBLICATIONS

Japanese Office Action mailed Aug. 21, 2012 for corresponding Japanese Application No. 2008-304394, with Partial English-language Translation.

* cited by examiner

*Primary Examiner* — Farzad Kazeminezhad
(74) *Attorney, Agent, or Firm* — Fujitsu Patent Center

(57) ABSTRACT

A computer implemented method comprising: setting a plurality of frames on a time axis between a first waveform of an input to audio processing and a second waveform of an output from the audio processing, detecting a voice frame and a noise frame in the first and second waveform, calculating a first and second spectrum from the first and second waveform, adjusting level of the first or second spectrum of the noise frame, setting the adjusted first and second spectrum of the noise frame as a third and fourth spectrum, calculating a distortion amount of the noise frame from the third and fourth spectrum, estimating a noise model spectrum from the first or second spectrum, determining a selected frequency by comparison of voice and noise frame spectrum levels, and calculating a distortion amount of the voice frame from the first and second spectrum of the voice frame at the selected frequency.

18 Claims, 12 Drawing Sheets

FIG. 5

$$A = \frac{\sum_{f=1}^{n} att(f)}{n}$$

FIG. 8

$$DIFF(f) = \left( \sqrt{X'_r{}^2 + X'_I{}^2} - \sqrt{Y_r{}^2 + Y_I{}^2} \right)^2$$

COMPUTER-READABLE MEDIUM FOR RECORDING AUDIO SIGNAL PROCESSING ESTIMATING A SELECTED FREQUENCY BY COMPARISON OF VOICE AND NOISE FRAME LEVELS

CROSS-REFERENCE TO RELATED APPLICATIONS

This application is based upon and claims the benefit of priority of the prior Japanese Patent Application No. 2008-304394, filed on Nov. 28, 2008, the entire contents of which are incorporated herein by reference.

FIELD

The present invention relates to an audio signal processing estimating program and an audio signal processing estimating device for estimating audio signal processing.

BACKGROUND

A subjective estimation and an objective estimation are known as a method of estimating the quality of an audio signal.

There is known an objective estimation method for comparing an original voice having no noise with an estimation target voice to calculate an objective estimation value as in the case of PESQ (Perceptual Evaluation of Speech Quality), for example. Furthermore, there is known a method of determining a relational expression of a subjective estimation value and the objective estimation value based on the subjective estimation value (MOS value: Mean Opinion Score value) as a result obtained by subjectively estimating a noise-contaminated voice by using a sample voice and the objective estimation value as a result obtained by objectively estimating the noise-contaminated voice by PESQ. These techniques are disclosed in Japanese Laid-open Patent Publication No. 2001-309483, Japanese Laid-open Patent Publication No. 7-84596 or Japanese Laid-open Patent Publication No. 2008-15443, for example.

In the audio quality estimating methods described above, it is impossible to determine a distortion amount of a noise-contaminated voice. Furthermore, the method of determining the relational expression of the subjective estimation value and the objective estimation value described above has a problem in that although the estimation precision for a voice contaminated with a noise similar to the noise of the sample voice is high, the estimation precision of a voice contaminated with a noise which is greatly different from the noise of the sample voice is low.

Furthermore, when audio signal processing such as directional sound reception processing, noise suppressing processing, or the like is executed on a noise-contaminated audio signal, distortion occurs in both a noise section and a voice section of the processed audio signal. In this case, with respect to the noise section, power is reduced due to the signal processing described above, and thus it is difficult to measure an accurate distortion amount. On the other hand, with respect to the voice section, it is difficult to obtain an estimation result near to the subjective estimation.

SUMMARY

According to an aspect of the invention, a computer-readable medium for recording an audio signal processing estimating program includes a program allowing the computer to execute: setting a plurality of frames, each of which has a specific period of time, on a common time axis between a first waveform as a time waveform of an input to the audio signal processing and a second waveform as a time waveform of an output from the audio signal processing; detecting from the plurality of frames a voice frame as a frame in which a specific voice exists in the first waveform and the second waveform, and a noise frame as a frame in which the specific voice does not exist in the first waveform or the second waveform; calculating a first spectrum corresponding to the spectrum of the first waveform and a second spectrum corresponding to the spectrum of the second waveform for the voice frame and the noise frame; adjusting the level of the first spectrum of the noise frame or the second spectrum of the noise frame so that the level of the first spectrum and the level of the second spectrum in the noise frame are substantially equal to each other, and setting the first spectrum of the noise frame after the level adjustment as a third spectrum of the noise frame while setting the second spectrum of the noise frame after the level adjustment as a fourth spectrum of the noise frame; calculating a distortion amount of the noise frame based on the third spectrum of the noise frame and the fourth spectrum of the noise frame; setting the first spectrum or the second spectrum to a fifth spectrum, and estimating a noise model spectrum as the spectrum of a noise model based on the fifth spectrum of the noise frame; selecting a frequency as a selected frequency based on comparison between the level of the fifth spectrum of the voice frame and the level of the noise model spectrum; and calculating a distortion amount of the voice frame based on the first spectrum of the voice frame and the second spectrum of the voice frame at the selected frequency.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 5 is an expression illustrating an example of a method of calculating an average attenuation amount of this embodiment;

FIG. 8 is an example of a calculation expression of a differential power spectrum when an imaginary part of a differential spectrum is not less than an imaginary part threshold value in this embodiment;

DESCRIPTION OF EMBODIMENTS

Embodiments of the present invention will be described hereunder with reference to the drawings.

In this embodiment, an audio signal processing device executes audio signal processing such as directional sound reception processing and noise suppressing processing. This audio signal processing handles a time waveform obtained by sampling an audio signal. The time waveform input to the above audio signal processing (before the audio signal processing) is referred to as "original voice waveform" (first waveform), and the time waveform output from the above audio signal processing (after the audio signal processing) is referred to as "target voice waveform" (second waveform).

An audio signal processing estimating device according to this embodiment executes audio signal processing estimating which includes calculating a distortion amount of the target voice waveform in relation to the original voice waveform as an estimation value of the audio signal processing.

The construction of the audio signal processing estimating device according to this embodiment will be described hereunder.

Figure 1:
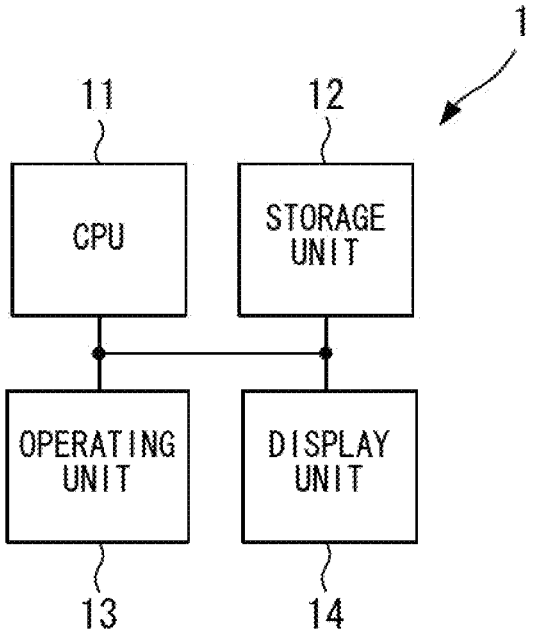
FIG. 1 is a block diagram illustrating an example of the construction of an audio signal processing estimating device according to an embodiment.

FIG. 1 is a block diagram illustrating an example of the construction of the audio signal processing estimating device according to this embodiment. The audio signal processing estimating device 1 has a CPU (Central Processing Unit) 11, a storage unit 12, an operating unit 13, and a display unit 14.

The storage unit 12 stores an audio signal processing estimating program, a waveform, audio signal processing estimation processing result, etc. The CPU 11 executes the audio signal processing estimating according to the audio signal processing estimating program. The operating unit 13 receives operations such as an indication of a waveform by a user. The display unit 14 displays a distortion amount as an output of the audio signal processing estimating program, etc.

The construction of the audio signal processing estimating program in the audio signal processing estimating device 1 will be described.

Figure 2:
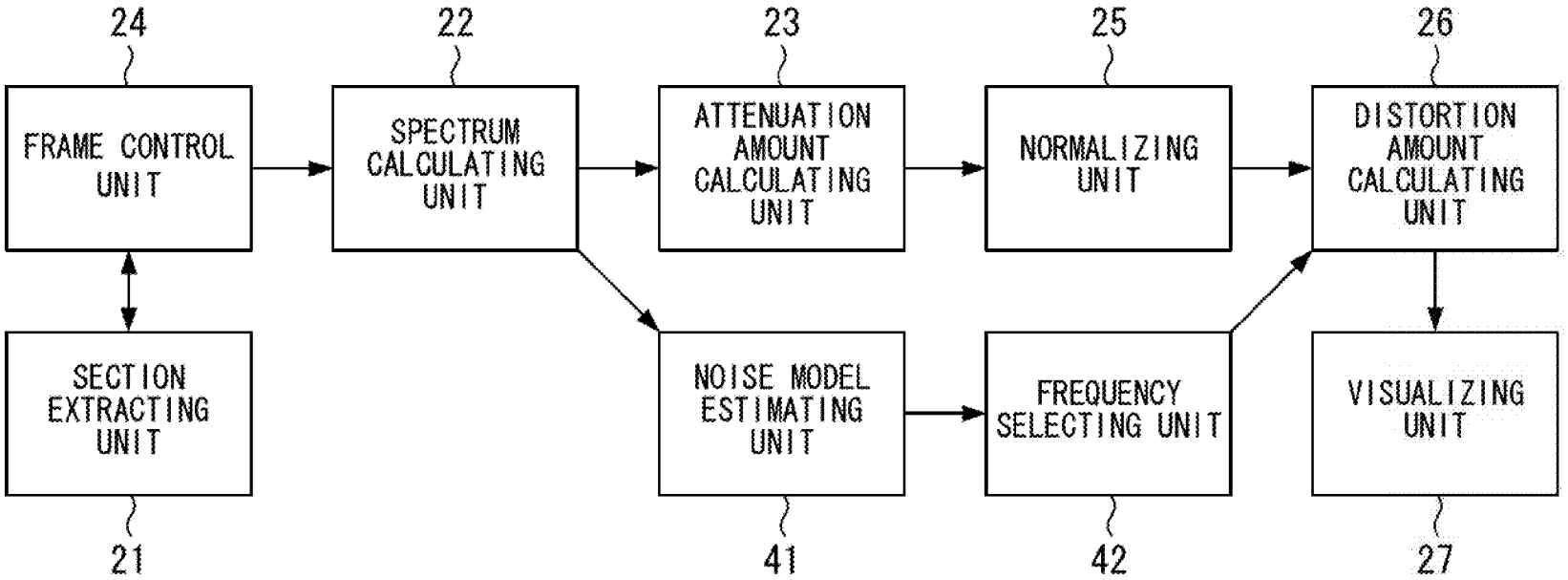
FIG. 2 is a block diagram illustrating an example of the construction of an audio signal processing estimating program according to the embodiment.

FIG. 2 illustrates an example of the construction of the audio signal processing estimating program according to this embodiment, and also it is a block diagram illustrating the functional blocks of a computer when the audio signal processing estimating program is executed by the computer. The computer executing the audio signal processing estimating program has a section extracting unit 21 (detecting unit), a spectrum calculating unit 22, an attenuation amount calculating unit 23, a frame control unit 24 (frame setting unit), a normalizing unit 25, a distortion amount calculating unit 26 (first distortion amount calculating unit, second distortion amount calculating unit), a visualizing unit 27, a noise model estimating unit 41, and a frequency selecting unit 42. The attenuation amount calculating unit 23 and the normalizing unit 25 correspond to a level adjusting unit.

The audio signal processing estimating processing will be described hereunder.

Figure 3:
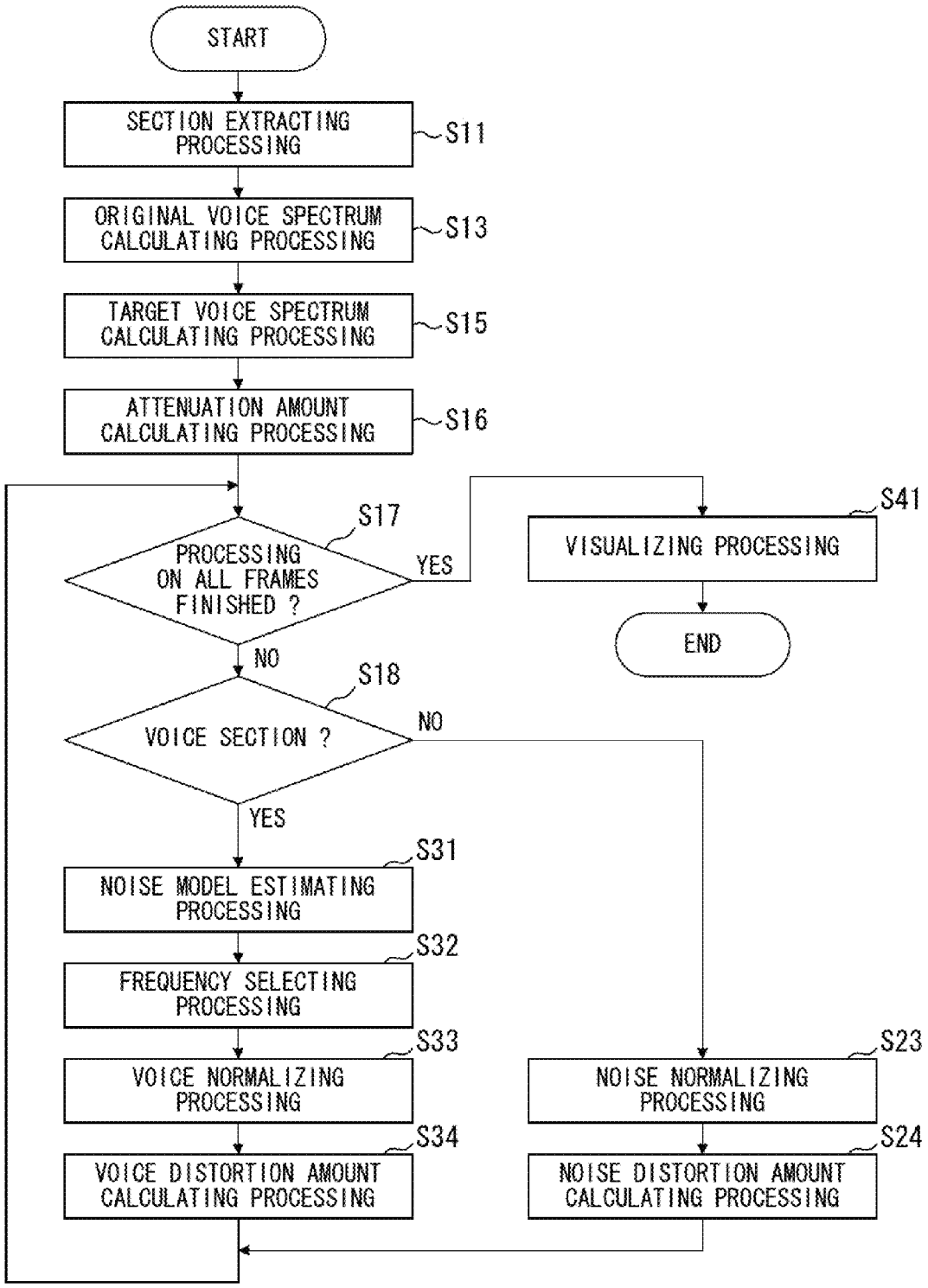
FIG. 3 is a flowchart illustrating an example of audio signal processing estimating processing according to the present invention.

FIG. 3 is a flowchart illustrating an example of the audio signal processing estimating processing. First, the frame control unit 24 and the section extracting unit 21 execute section extracting processing (S11).

The details of the section extracting processing will be described hereunder.

First, the frame control unit 24 obtains a waveform from the storage unit 12, and divides the original voice waveform and the target voice waveform into sample frames of FFT length n (where n represents the N-th power of 2) of the spectrum calculating unit 22. Subsequently, the section extracting unit 21 determines whether each frame is any one of a voiced sound frame, an unvoiced sound frame, or a mixed frame of voiced sound and unvoiced sound. Here, when the frame is a frame having a waveform level which is not less than a specific voiced sound threshold value (for example, a specific voice exists), the section extracting unit 21 determines that the frame concerned is a voiced sound frame. When the frame is a frame having a waveform level which does not exceed the voiced sound threshold value, the section extracting unit 21 determines that the frame concerned is an unvoiced sound frame. When the frame is neither the former frame nor the latter frame, the section extracting unit 21 determines that the frame concerned is a mixed frame.

Subsequently, the section extracting unit 21 sets a non-sequential and single voiced sound frame or sequential plural voiced sound frames as a voice section, and also sets a non-sequential and single unvoiced sound frame or sequential plural unvoiced sound frames as a noise section. Here, the section extracting unit 21 creates label data representing the timings of the voiced sound section and the unvoiced sound section as labels. The voice section contains both voice and noise. The frame of the voice section corresponds to the voice frame, and the frame of the noise section corresponds to the noise frame.

Figure 4:
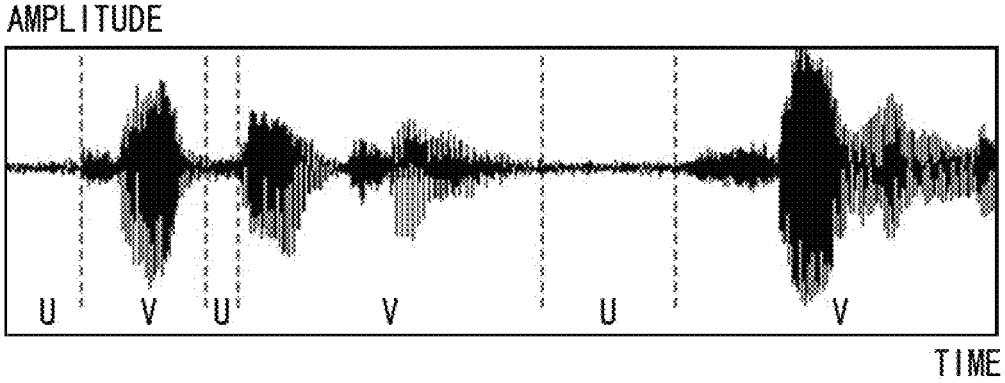
FIG. 4 is a label data and waveform diagram illustrating an example of a voice section and a noise section in a target voice waveform of the embodiment.

FIG. 4 is a diagram illustrating label data and a waveform which illustrate an example of a voice section and a noise section in the target voice waveform of this embodiment. In FIG. 4, the abscissa axis represents the time, and the ordinate axis represents the amplitude. The waveform illustrated in FIG. 4 is a target voice waveform. In FIG. 4, "V" represents a voice section and "U" represents a noise section.

The subsequence of the audio signal processing estimating processing will be described hereunder.

Subsequently, the spectrum calculating unit 22 executes original voice spectrum calculation processing which includes calculating an original voice spectrum (first spectrum) as the spectrum (frequency characteristic) of the original voice waveform (S13). Subsequently, the spectrum calculating unit 22 obtains the target voice waveform from the storage unit 12, and executes target voice spectrum calculation processing which includes calculating a target voice spectrum (second spectrum) as the spectrum of the target voice waveform and storing the calculated target voice spectrum in the storage unit 12 (S15).

The details of the original voice spectrum calculation processing and the target voice spectrum calculation processing will be described hereunder.

The spectrum calculating unit 22 obtains the original voice waveform from the storage unit 12, executes FFT (Fast Fourier Transform) on each frame of the original voice waveform and stores the original voice spectrum as the FFT result in the storage unit 12. The spectrum calculating unit 22 obtains the target voice waveform from the storage unit 12, executes FFT on each frame of the target voice waveform and stores the target voice spectrum as the FFT result in the storage unit 12. The spectrum calculating unit 22 may use a filter bank in place of FFT, and process waveforms of a plurality of bands obtained by the filter bank in a time area. Furthermore, conversion from another time area to a frequency area (wavelet conversion or the like) may be used instead of FFT.

Here, when the original voice waveform of each section is represented by x(t), the target voice waveform y(t) of each section is represented by y(t) and the function of FFT is represented by fft, the original voice spectrum X(f) and the target voice spectrum Y(f) are represented by the following expressions.

$$X(f)=fft(x)$$

$$Y(f)=fft(y)$$

The spectrum calculating unit 22 calculates an original voice power spectrum |X(f)|2 as the power of the original voice spectrum in every frame. Furthermore, the spectrum calculating unit 22 also calculates a target voice power spectrum |Y(f)|2 as the power of the target voice spectrum in every frame.

The continuation of the audio signal processing estimating processing will be described hereunder.

The attenuation amount calculating unit 23 executes attenuation amount calculating processing which includes calculating the attenuation amount (level ratio) of the target voice power spectrum corresponding to the original voice power spectrum (S16).

The details of the attenuation amount calculating processing will be described hereunder.

First, the attenuation amount calculating unit 23 obtains the original voice power spectrum and the target voice power spectrum from the storage unit 12 for every frame. The attenuation amount calculating unit 23 calculates an attenuation amount spectrum att(f) corresponding to the ratio of the original voice power spectrum to the target voice power spectrum (the attenuation amount of the target voice power spectrum corresponding to the original voice power spectrum), and stores the attenuation amount spectrum att(f) in the storage unit 12. Here, the attenuation amount spectrum is represented by the following expression.

$$att(f)=|X(f)|2/|Y(f)|2$$

The attenuation amount calculating unit 23 averages the attenuation amount spectrum over all the frequencies, and sets the average result as an average attenuation amount A. FIG. 5 illustrates an expression representing an example of the calculation method of the average attenuation amount of this embodiment.

Figure 6:
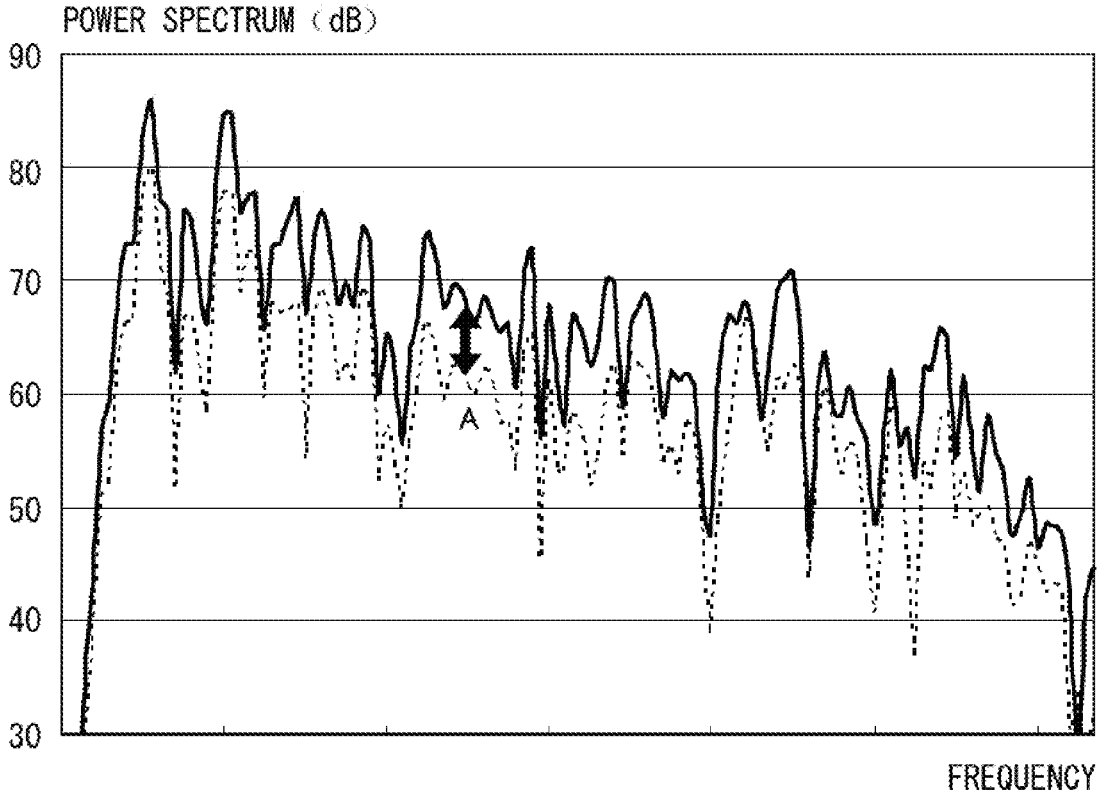
FIG. 6 is a power spectral diagram illustrating an example of an original voice power spectrum and a target voice power spectrum in the noise section of this embodiment.

FIG. 6 is a power spectral diagram illustrating an example of the original voice power spectrum and the target voice power spectrum in the noise section according to this embodiment. In FIG. 6, the abscissa axis represents the frequency, and the ordinate axis represented the power. In FIG. 6, a solid-line plot represents the original voice power spectrum in a frame within a certain noise section, and a dashed-line plot represents the target voice power spectrum in the same frame. Furthermore, FIG. 6 illustrates the average attenuation amount A.

The attenuation amount calculating unit 23 stores the calculated average attenuation amount in the storage unit 12.

The continuation of the audio signal processing estimating processing will be described hereunder.

The frame control unit 24 determines whether the processing on all the frames is finished or not (S17).

When the processing on all the frames is not finished (S17, NO), the frame control unit 24 selects frames one by one as a selected frame in order of time, and determines, based on the label data, whether the selected frame is a voice section or not (S18).

When the selected frame is a noise section (S18, NO), the normalizing unit 25 executes noise normalization processing which includes matching (normalizing) the level of the original voice spectrum in the selected frame with the level of the target voice spectrum to obtain a normalized original voice spectrum (S23).

The details of the noise normalization processing will be described hereunder.

First, the original voice spectrum, the target voice spectrum and the average attenuation amount in the selected frame are obtained from the storage unit 12 by the normalizing unit 25. Then, the normalizing unit 25 attenuates the original voice spectrum by only the average attenuation amount to obtain the normalized original voice spectrum, and stores the thus-obtained normalized original voice spectrum in the storage unit 12. Here, the normalized original voice spectrum X'(f) is represented by the following expression.

$$X'(f)=X(f)/A$$

Figure 7:
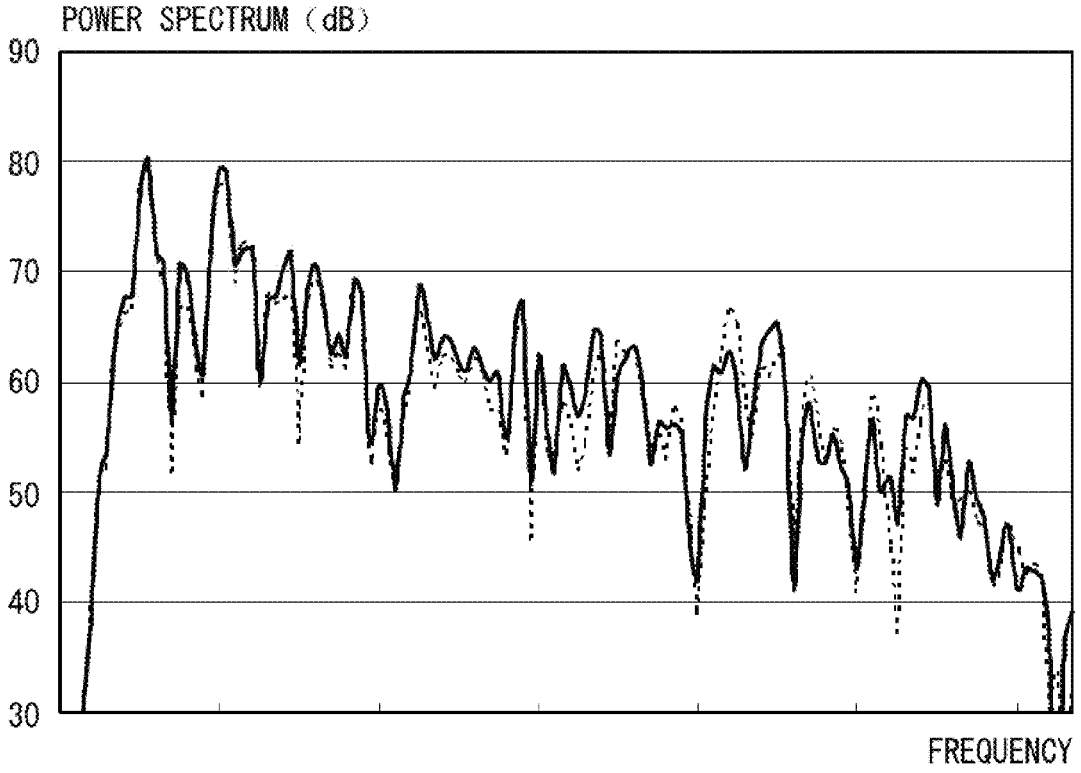
FIG. 7 is a power spectral diagram illustrating an example of a normalized original voice power spectrum and a target voice power spectrum in a noise section of this embodiment.

FIG. 7 is a power spectral diagram illustrating an example of the normalized original voice spectrum and the target voice power spectrum in the noise section according to this embodiment. In FIG. 7, the abscissa axis represents the frequency, and the ordinate axis represents the power. In FIG. 7, a solid-line plot represents the normalized original voice power spectrum in a frame within a certain noise section, and a dashed-line plot represents a target voice power spectrum in the frame. As illustrated in FIG. 7, the normalized original voice power spectrum and the target voice power spectrum have approximately the same average level, however, they are different in the shape of the power spectrum.

According to the noise normalization processing described above, the distortion amount may be measured on the assumption that the decrease amount of the power due to the audio signal processing is excluded.

The continuation of the audio signal processing estimating processing will be described hereunder.

The distortion amount calculating unit 26 executes the noise distortion amount calculating processing which includes calculating the distortion amount spectrum and the distortion amount of the selected frame (S24), and then the flow returns to S17.

The details of the noise distortion amount calculating processing will be described hereunder.

First, the distortion amount calculating unit 26 obtains the normalized original voice spectrum and the target voice spectrum in the selected frame from the storage unit 12. The distortion amount calculating unit 26 subtracts the normalized original voice spectrum from the target voice spectrum to obtain a differential spectrum, and calculates the power of the differential spectrum as a differential power spectrum. Here, when the real part of X'(f) is represented by X'r(f), the imaginary part of X'(f) is represented by X'i(f), the real part of Y'(f) is represented by Yr(f) and the imaginary part of Y(f) is represented by Yi(f). The DIFF(f) of the differential power spectrum is represented by the following expression.

$$\mathrm{DIFF}(f)=(X'r(f)-Yr(f))2+(X'i(f)-Yi(f))2$$

The distortion calculating unit 26 calculates the ratio of the differential power spectrum to the normalized original voice power spectrum as the distortion amount spectrum. The distortion amount calculating unit 26 averages the distortion amount spectrum over all the frequencies and sets the average result as a distortion amount. The distortion calculating unit 26 stores the distortion amount of the selected frame in the storage unit 12.

When a great variation occurs in phase due to the audio signal processing, the imaginary part of the differential spectrum is increased. The distortion amount calculating unit 26 switches the calculation expression of the differential power spectrum DIFF(f) to the following expression when the imaginary part of the differential spectrum is not less than a specific imaginary part threshold value. FIG. 8 illustrates an example of the calculation expression of the differential power spectrum when the imaginary part of the differential spectrum is not less than the imaginary part threshold value in this embodiment. Here, the imaginary part threshold value is set as the ratio of the imaginary part of the differential spectrum to the normalized original voice power spectrum.

The continuation of the audio signal processing estimating processing will be described hereunder.

When the selected frame is a voice section (S18, YES), the noise model estimating unit 41 executes noise model estimating processing which includes estimating the noise model of the voice section of the selected frame based on the noise section near the voice section of the selected frame (S31).

The details of the noise model estimating processing will be described hereunder.

First, the noise model estimating unit 41 sets the voice section containing the selected frame as a selected voice section, and obtains from the storage unit 12 the original voice power spectrum of a preceding noise frame corresponding to the frame of a noise section just preceding the selected voice section and of a subsequent noise frame corresponding to the first frame of a noise section just subsequent to the selected voice section. Then, the noise model estimating unit 41 calculates the average level of the original voice power spectrum of the preceding noise frame and the average level of the original voice power spectrum of the subsequent noise frame.

Figure 9:
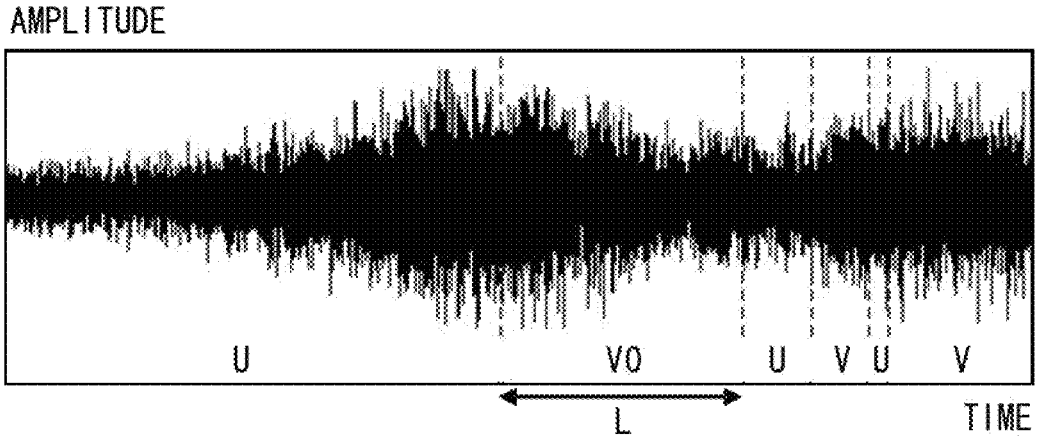
FIG. 9 is a waveform diagram illustrating an example of an original voice waveform in a selected voice section and noise sections before and after the selected voice section in the embodiment.

FIG. 9 is a waveform diagram illustrating an example of the original voice waveforms in the selected voice section and the noise sections before and after the selected voice section according to this embodiment. In FIG. 9, the abscissa axis represents the time, and the ordinate axis represents the amplitude. In FIG. 9, "V" represents the voice section, "U" represents the noise section, and "V0" represents the selected voice section. In FIG. 9, the difference between the average level of the preceding noise frame and the average level of the subsequent noise frame is large. Furthermore, the noise level within the selected voice section is reduced over time. As described above, when the selected voice section is relatively long, the variation amount of the noise level before and after the voice section may be increased in some cases.

Subsequently, the noise model estimating unit 41 calculates a noise model power spectrum (a noise model spectrum) as the power spectrum of the noise model of the selected frame from the original voice power spectrum of the preceding noise frame and the original voice power spectrum of the subsequent noise frame, and stores the calculated noise model power spectrum in the storage unit 12. Here, when the original voice power spectrum of the preceding noise frame is represented by Zbfr(f) and the original voice power spectrum of the subsequent noise frame is represented by Zaft(t), the noise model power spectrum Z(f) of the selected frame is represented by the following expression.

$$Z(f)=\alpha Zbfr(f)+(1.0-\alpha)Zaft(f)$$

Here, $\alpha<1.0$

Here, when the time length of the selected voice section is represented by "L" and the time from the start point of the selected voice section is represented by "n," the weighting $\alpha$ of the preceding noise frame is represented by the following expression.

$$\alpha=(L-n)/L$$

When the noise level variation amount corresponding to the difference between the average level of the preceding noise frame and the average level of the subsequent noise frame is not more than a specific noise level variation amount threshold value, or when L is not more than a specific selected voice section time length threshold value, the noise model estimating unit 41 may determine that the level variation of the noise within the selected voice section is small, and set the original voice power spectrum in the preceding noise section or the subsequent noise section as the noise model power spectrum.

The continuation of the audio signal processing estimating processing will be described hereunder.

The frequency selecting unit 42 executes frequency selecting processing of selecting the frequency based on the original voice power spectrum and the noise model power spectrum in the selected frame (S32).

The details of the frequency selecting processing will be described hereunder.

First, the frequency selecting unit 42 obtains the original voice power spectrum and the noise model power spectrum in the selected frame from the storage unit 12. The frequency selecting unit 42 compares the level of the original voice power spectrum with the level of the noise model power spectrum for every frequency.

Here, the frequency selecting unit 42 adds the noise model power spectrum with a specific margin and sets the addition result as a threshold power spectrum. Furthermore, the frequency selecting unit 42 selects a frequency at which the level of the original voice power spectrum is not less than the level of the threshold power spectrum, and sets the frequency concerned as a selected frequency. In this embodiment, the margin is set to zero, and the threshold power spectrum is substantially equal to the noise model power spectrum.

Figure 10:
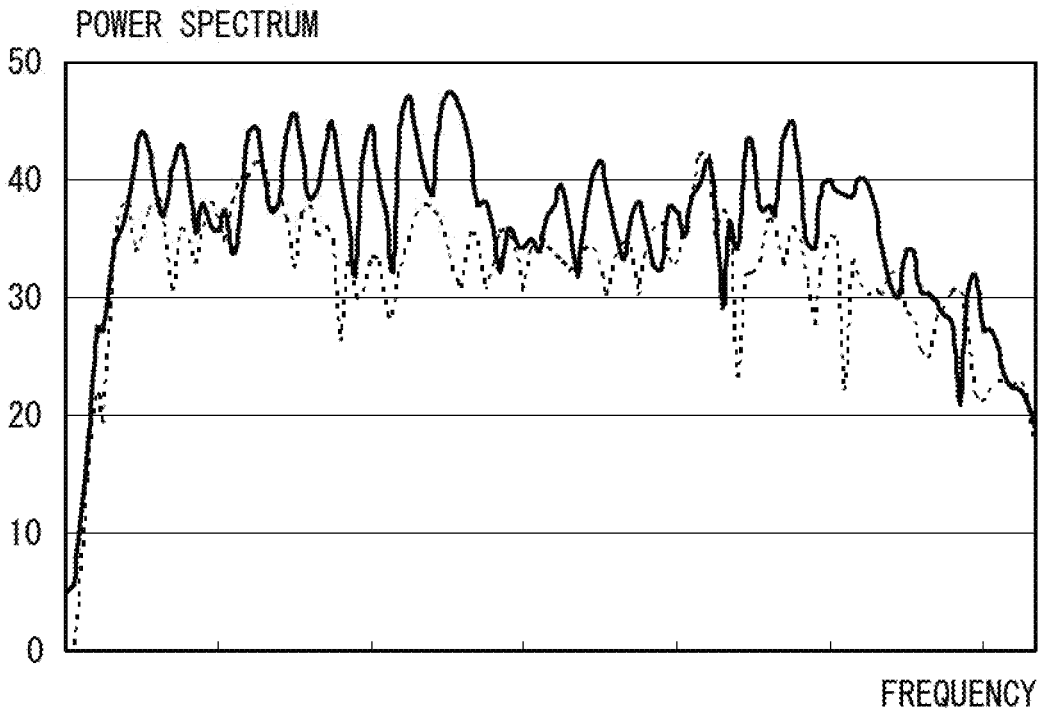
FIG. 10 is a power spectral diagram illustrating an example of an original voice power spectrum and a noise model power spectrum in a voice section of the embodiment.

FIG. 10 is a power spectral diagram illustrating an example of the original voice power spectrum and the noise model power spectrum in the voice section according to this embodiment. In FIG. 10, a solid-line plot represents the original voice power spectrum in a frame within a certain voice section, and a dashed line plot represents the noise model power spectrum in the frame. The range of frequencies at which the level of the original voice power spectrum is not less than the level of the noise model power spectrum (threshold power spectrum) is the selected frequency.

The continuation of the audio signal processing estimating processing will be described hereunder.

The normalizing unit 25 executes the voice normalizing processing which includes matching (normalizing) the level of the original voice spectrum in the selected frame with the level of the target voice spectrum to obtain the normalized original voice spectrum.

The details of the voice normalizing processing will be described hereunder.

The voice normalizing processing is the same as the noise normalizing processing. First, the normalizing unit 25 obtains the original voice spectrum, the target voice spectrum and the average attenuation amount of the selected frame from the storage unit 12. Then, the normalizing unit 25 attenuates the original voice spectrum by only the amount corresponding to the average attenuation amount and sets the attenuated original voice spectrum as the normalized original voice spectrum, and then stores the normalized original voice spectrum in the storage unit 12.

The continuation of the audio signal processing estimating processing will be described hereunder.

The distortion amount calculating unit 26 executes voice distortion amount calculating processing which includes calculating the distortion amount spectrum and the distortion amount in the selected frame (S34), and then the flow returns to S17.

The details of the voice distortion amount calculating processing will be described hereunder.

First, the distortion amount calculating unit 26 obtains the normalized original voice spectrum, the target voice spectrum, and the selected frequency in the selected frame from the storage unit 12. The distortion amount calculating unit 26 subtracts the normalized original voice spectrum from the target voice spectrum to obtain a differential spectrum, and calculates the power of the differential spectrum to obtain a differential power spectrum. The distortion amount calculating unit 26 calculates the ratio of the differential power spectrum to the normalized original voice power spectrum as the distortion amount spectrum.

The distortion amount calculating unit 26 determines a weighting spectrum as frequency-based weighting. Three examples of the weighting determining method will be described hereunder.

In a first weighting determining method, the distortion amount calculating unit 26 applies a larger weight as the frequency provides a larger power spectrum.

In a second weight determining method, the distortion amount calculating unit 26 applies a larger weight to a frequency band of 300 Hz to 3400 Hz which is a human voice (speech) frequency zone, and applies a smaller weight to other frequency bands.

In a third weighting determining method, the distortion amount calculating unit 26 executes formant detection to apply a larger weight to frequencies in the neighborhood of a first formant frequency and apply a smaller weight to other bands.

The distortion amount calculating unit 26 multiplies the voice distortion amount spectrum by the weighting spectrum every frequency.

The distortion amount calculating unit 26 averages the distortion amount spectrum over all the selected frequencies and sets the average value as a distortion amount. The distortion amount calculating unit 26 stores the distortion amount of the selected frame in the storage unit 12.

According to the voice distortion amount calculating processing, only components which are able to be heard may be estimated with excluding components which cannot be heard due to the effect of the noise.

The distortion amount calculating unit 26 may average the distortion amounts of all the frames in the voice section which are calculated through the voice distortion amount calculating processing, and set the average result as the average voice distortion amount. Furthermore, the distortion amount calculating unit 26 may average the distortion amounts of all the frames in the noise section which are calculated through the noise distortion amount calculating processing, and set the average result as the average noise distortion amount.

The continuation of the audio signal processing estimating processing will be described hereunder.

When the processing on all the frames in the processing S17 is finished (S17, Y), the visualizing unit 27 executes visualizing processing of visualizing the distortion amount (S41), and then this flow is finished.

The details of the visualizing processing will be described hereunder.

First, the visualizing unit 27 obtains the original voice waveform, the target voice waveform, and the distortion amount of each frame from the storage unit 12. The visualizing unit 27 displays the original voice waveform, the target voice waveform, and the distortion amount of each frame on the display unit 14.

Figure 11:
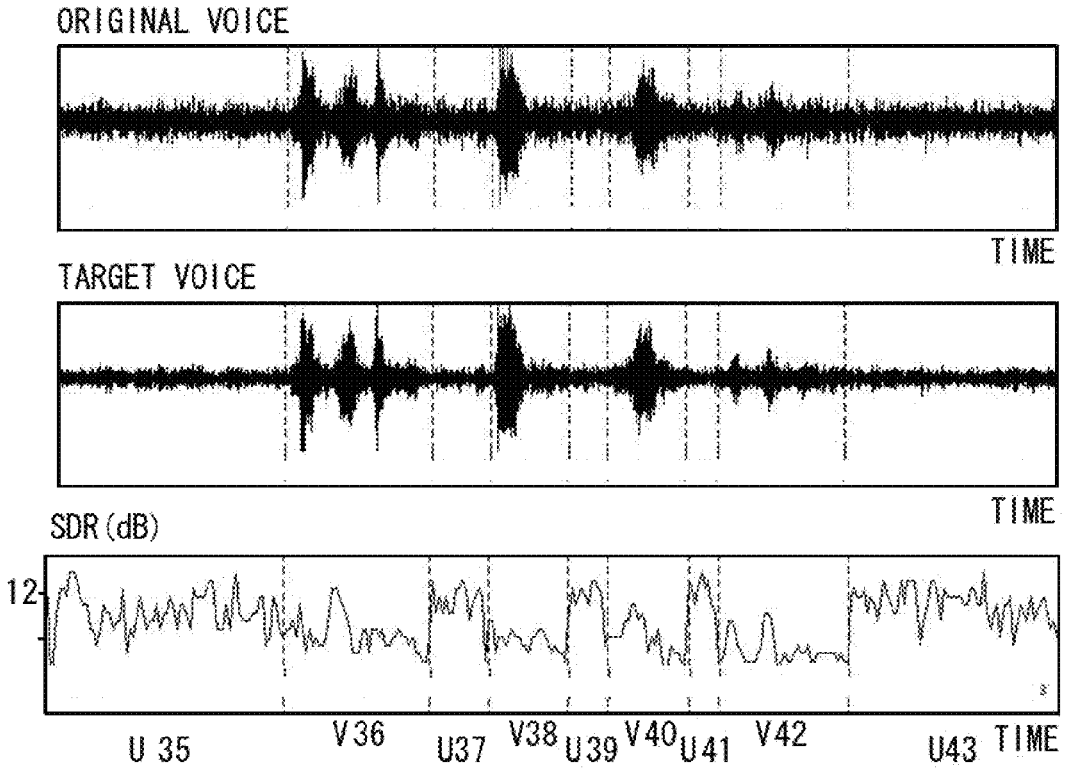
FIG. 11 includes waveform diagrams illustrating an example of an original voice waveform, a target voice waveform, and a distortion amount time variation in the embodiment.

FIG. 11 is a waveform diagram illustrating an example of the original voice waveform, the target voice waveform, and the time variation of the distortion amount according to this embodiment. The three waveforms in FIG. 11 represent the original voice waveform, the target voice waveform, and the distortion amount time variation in order from the upper side. In the three waveforms, the abscissa axis represents the time. In the original voice waveform and the target voice waveform, the ordinate axis represents the amplitude. In the distortion amount time variation, the ordinate axis represents the distortion amount (SDR: Signal to Distortion Ratio). The distortion amount time variation is the distortion amount of each frame. In FIG. 11, U representing a noise section, V representing a voice section, and numbers identifying each section are appended to respective sections. Here, U35, U37, U39, U41, and U43 represent noise sections, and V36, V38, V40, and V42 represent voice sections.

According to the visualizing processing described above, the time variation of the distortion amount may be listed, and also the association between the distortion amount and the timing and the association between the original voice waveform for check and the target waveform may be easily performed.

In the noise normalizing processing and the voice normalizing processing, the normalizing unit 25 may match the level of the target voice spectrum with the level of the original voice spectrum.

The original voice spectrum after the noise normalizing processing (the normalized original voice spectrum) and the target voice spectrum correspond to the third spectrum and the fourth spectrum, respectively.

The noise model estimating unit 41 may calculate the noise model power spectrum from the target voice power spectrum of the noise section, and the frequency selecting unit 42 may compare the target voice power spectrum and the noise model power spectrum in the voice section, thereby determining the selected frequency.

Furthermore, the original voice power spectrum or the target voice power spectrum used for the estimation of the noise model power spectrum corresponds to the fifth spectrum.

The attenuation amount calculating processing, the noise normalizing processing, and the voice normalizing processing correspond to the level adjustment.

According to this embodiment, the distortion amount as the estimation value calculated through the audio signal processing estimating processing for the audio signal processing is nearer the trend of the subjective estimation value as compared to the conventional objective estimation value.

According to this embodiment, the noise distortion and the voice distortion caused by the audio signal processing such as the noise suppression processing, and the directional sound receiving processing may be calculated as values nearer the subjective estimation. Accordingly, the estimation of the speech quality may be performed in a short period of time without executing any subjective estimation tests which need much time and cost.

The audio signal processing estimating processing according to this embodiment may be not only applied to the estimation test of the audio signal processing, but also installed in an audio signal processing tuning tool to increase the noise suppression amount or enhance the speech quality. Furthermore, the audio signal processing estimating processing of this embodiment may be installed in a noise suppressing device for changing parameters while learning an audio signal processing estimating processing result on a real-time basis. Still furthermore, the audio signal processing estimating processing of this embodiment may be applied to a noise environment measurement estimating tool. The audio signal processing estimating processing of this embodiment may be installed in a noise suppressing device for selecting optimum noise suppression processing based on the measurement result of the noise environment.

According to the present invention, the constituent elements of the above embodiment or any combination of the constituent elements may be applied to a method, a device, a system, a recording medium, a data structure, etc.

For example, this embodiment is applicable to a computer system described below.

Figure 12:
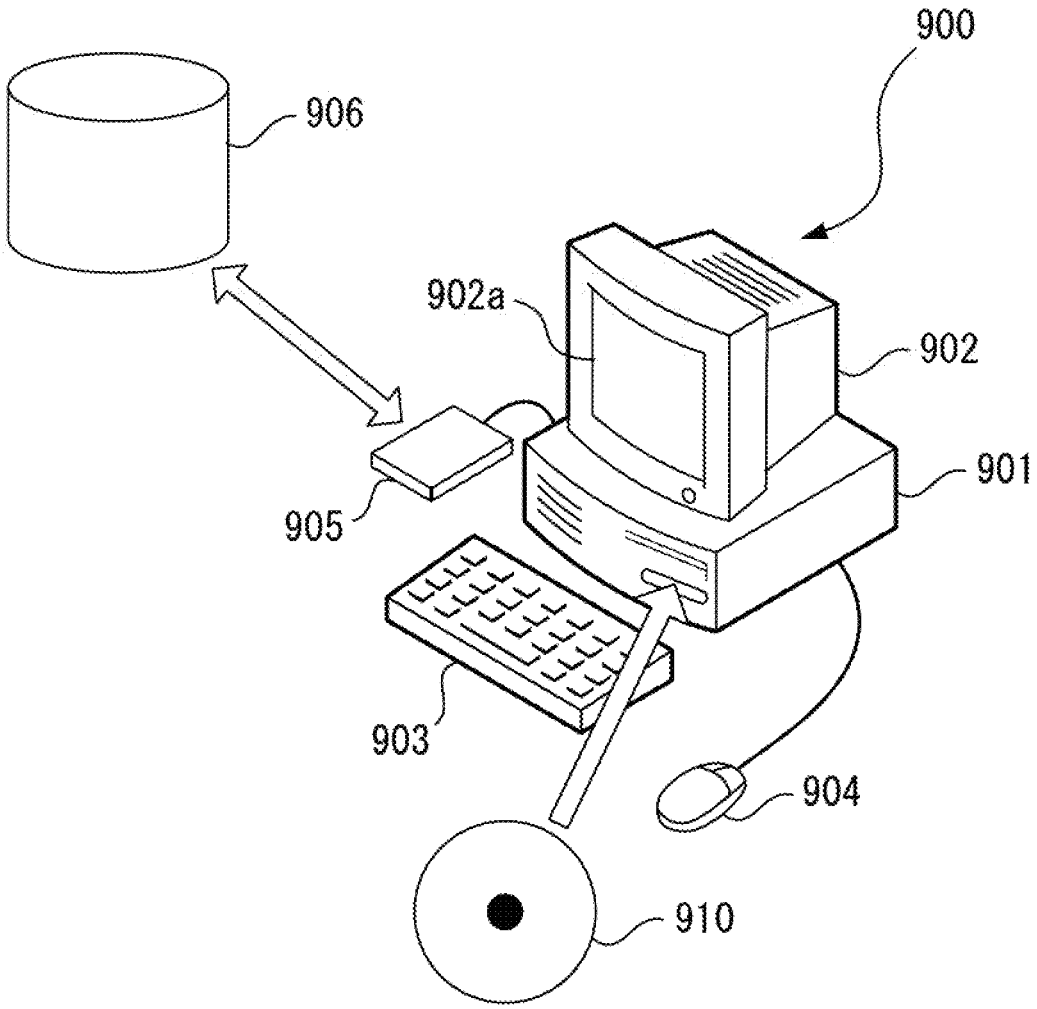
FIG. 12 is a diagram illustrating an example of a computer system to which the present invention is applied.

FIG. 12 is a diagram illustrating an example of a computer system to which this embodiment is applied. A computer system 900 illustrated in FIG. 12 has a main body portion 901 including CPU, a disk drive, etc., a display 902 for displaying an image in response to an instruction from the main body portion 901, a keyboard 903 for inputting various information to the computer system 900, a mouse 904 for indicating a position on a display screen 902*a* of the display 902, and a communication device 905 for accessing an external data base or the like to download a program, etc. stored in another computer system. The communication device 905 may comprise a network communication card, a modem or the like.

As described above, in the computer system including the audio signal processing estimating device, a program for executing each of the steps described above may be provided as an audio signal processing estimating program. This program is stored in a recording medium from which the program may be read out by the computer system, whereby the computer system including the audio signal processing estimating device may execute the program. The program for executing each of the steps described above is stored in a portable recording medium such as a disk 910, or downloaded from a recording medium 906 of another computer system by the communication device 905. Furthermore, the audio signal processing estimating program included in the computer system 900 with at least an audio signal processing estimation function is input into the computer system 900 to be compiled. This program makes the computer system 900 operate as an audio signal processing estimating system having the audio signal processing estimating function. Furthermore, this program may be stored in a computer-readable recording medium such as the disk 910, for example. Here, examples of a recording medium readable by the computer system 900 include an internal storage device mounted in a computer such as ROM and RAM, a portable recording medium such as the disk 910, a flexible disk, a DVD disk, a magneto-optical disk, and an IC card, a data base holding computer programs, or various kinds of recording media which are accessible by another computer system and a computer system connected through a data base thereof or communication apparatus such as the communication device 905.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A non-transitory computer-readable medium for recording an audio signal processing estimating program allowing a computer to execute estimation of audio signal processing, the audio signal processing estimating program allowing the computer to execute:

setting a plurality of frames each of which has a specific period of time on a common time axis between a first waveform as a time waveform of an input to the audio signal processing and a second waveform as a time waveform of an output from the audio signal processing;

detecting, from the plurality of frames, a voice frame as a frame in which a specific voice exists in both of the first waveform and the second waveform, and a noise frame as a frame in which the specific voice does not exist in the first waveform nor the second waveform;

calculating a first spectrum corresponding to a spectrum of the first waveform and a second spectrum corresponding to a spectrum of the second waveform for the voice frame and the noise frame;

adjusting a level of the first spectrum of the noise frame or the second spectrum of the noise frame so that the level of the first spectrum and the level of the second spectrum in the noise frame are substantially equal to each other, and setting the first spectrum of the noise frame after the level adjustment as a third spectrum of the noise frame while setting the second spectrum of the noise frame after the level adjustment as a fourth spectrum of the noise frame;

calculating a distortion amount of the noise frame based on the third spectrum of the noise frame and the fourth spectrum of the noise frame;

setting the first spectrum or the second spectrum to a fifth spectrum, and estimating a noise model spectrum as the spectrum of a noise model based on the fifth spectrum of the noise frame;

selecting a frequency as a selected frequency based on a comparison between a level of the fifth spectrum of the voice frame and a level of the noise model spectrum; and calculating a distortion amount of the voice frame based on the first spectrum of the voice frame and the second spectrum of the voice frame at the selected frequency, wherein the selecting, adds a noise model power spectrum including a specific margin, sets the addition of the noise model power spectrum as a threshold power spectrum, and selects a frequency in which a level of an original voice power spectrum is not less than the level of the threshold power spectrum.

2. The medium according to claim 1, wherein the audio signal processing estimating program allows the computer to further execute:

subtracting the third spectrum of the voice frame from the fourth spectrum of the voice frame to obtain a differential spectrum of the voice frame, and calculating a distortion amount of the voice frame based on the third spectrum and the differential spectrum of the voice frame.

3. The medium according to claim 2, wherein the audio signal processing estimating program allows the computer to further execute:

calculating a distortion amount of the voice frame based on a ratio of a power of the differential spectrum of the voice frame to a power of the third spectrum of the voice frame.

4. The medium according to claim 3, wherein the audio signal processing estimating program allows the computer to further execute:

calculating a spectrum of the ratio of the power of the differential spectrum of the voice frame to the power of the third spectrum of the voice frame, and calculating the distortion amount of the voice frame based on a value obtained by performing a weighting of the spectrum concerned and averaging the weighted spectrum over all the selected frequencies.

5. The medium according to claim 4 recorded with the audio signal processing estimating program, wherein the weighting is based on an auditory characteristic.

6. The medium according to claim 2, wherein the audio signal processing estimating program allows the computer to further execute:

Subtracting a power of the third spectrum of the voice frame from a power of the fourth spectrum of the voice frame when an imaginary part of the differential spectrum of the voice frame exceeds a specific imaginary part threshold value, and setting the subtracted power as a power of the differential spectrum of the voice frame.

7. The medium according to claim 1, wherein the audio signal processing estimating program allows the computer to further execute:

subtracting the third spectrum of the noise frame from the fourth spectrum of the noise frame to obtain a differential spectrum of the noise frame; and calculating the distortion amount of the noise frame based on the third spectrum and the differential spectrum of the noise frame.

8. The medium according to claim 7, wherein the audio signal processing estimating program allows the computer to further execute:

calculating the distortion amount of the noise frame based on the ratio of a power of the differential spectrum of the noise frame to a power of the third spectrum of the noise frame.

9. The medium according to claim 7, wherein the audio signal processing estimating program allows the computer to further execute:

calculating a spectrum of the ratio of the power of the differential spectrum of the noise frame to the power of the third spectrum of the noise frame, and calculating the distortion amount of the noise frame based on an average value of the spectrum over a specific band.

10. The medium according to claim 7, wherein the audio signal processing estimating program allows the computer to further execute:

subtracting the power of the third spectrum of the noise frame from the power of the fourth spectrum of the noise frame when an imaginary part of the differential spectrum of the noise frame exceeds a specific imaginary part threshold value to obtain a power of the differential spectrum of the noise frame.

11. The medium according to claim 1, wherein the audio signal processing estimating program allows the computer to further execute:

estimating the noise model spectrum based on the fifth spectrum of a noise frame just before the voice frame and the fifth spectrum of a noise frame just after the voice frame.

12. The medium according to claim 11, wherein the audio signal processing estimating program allows the computer to further execute:

calculating the power of the noise model spectrum by linearly interpolating a power of the fifth spectrum of the noise frame just before the voice frame and a power of the fifth spectrum of the noise frame just after the voice frame.

13. The medium according to claim 1, wherein the audio signal processing estimating program allows the computer to further execute:

selecting, as the selected frequency, a frequency at which a level of the first spectrum in the voice frame is larger than a level obtained by adding the level of the noise model spectrum to a specific margin.

14. The medium according to claim 1, wherein the audio signal processing estimating program allows the computer to further execute:

adjusting a level of the first spectrum of the voice frame or the second spectrum of the voice frame so that the level of the first spectrum and the level of the second spectrum in the voice frame are substantially equal to each other, and determining the first spectrum of the voice frame after the level adjustment as a third spectrum of the voice frame while determining the second spectrum of the voice frame after the level adjustment as a fourth spectrum of the voice frame, and calculating the distortion amount of the voice frame based on the third spectrum of the voice frame and the fourth spectrum of the voice frame at the selected frequency.

15. The medium according to claim 1, wherein the audio signal processing estimating program allows the computer to further execute:

calculating an average value of distortion amounts of all the noise frames and an average value of distortion amounts of all the voice frames.

16. The medium according to claim 1, wherein the audio signal processing estimating program allows the computer to further execute:

displaying a time axis and the calculated distortion amount in association with each other for the voice frame and the noise frame.

17. The medium according to claim 1, wherein the audio signal processing estimating program allows the computer to further execute:

performing Fourier Transform on the first waveform to calculate the first spectrum and performing Fourier Transform on the second waveform to calculate the second spectrum for the voice frame and the noise frame.

18. An audio signal processing estimating device comprising;

a processor; and a memory which stores a plurality of instructions, which when executed by the processor, cause the processor to execute, setting a plurality of frames each of which has a specific period of time on a common time axis between a first waveform as a time waveform of an input to the audio signal processing and a second waveform as a time waveform of an output from the audio signal processing;

detecting, from the plurality of frames, a voice frame as a frame in which a specific voice exists in both of the first waveform and the second waveform, and a noise frame as a frame in which the specific voice does not exist in the first waveform nor the second waveform;

calculating a first spectrum corresponding to a spectrum of the first waveform and a second spectrum corresponding to a spectrum of the second waveform for the voice frame and the noise frame;

adjusting a level of the first spectrum of the noise frame or the second spectrum of the noise frame so that the level of the first spectrum and the level of the second spectrum in the noise frame are substantially equal to each other, and setting the first spectrum of the noise frame after the level adjustment as a third spectrum of the noise frame while setting the second spectrum of the noise frame after the level adjustment as a fourth spectrum of the noise frame;

calculating a distortion amount of the noise frame based on the third spectrum of the noise frame and the fourth spectrum of the noise frame;

setting the first spectrum or the second spectrum to a fifth spectrum, and estimating a noise model spectrum as the spectrum of a noise model based on the fifth spectrum of the noise frame;

selecting a frequency as a selected frequency based on a comparison between a level of the fifth spectrum of the voice frame and a level of the noise model spectrum; and calculating a distortion amount of the voice frame based on the first spectrum of the voice frame and the second spectrum of the voice frame at the selected frequency, wherein the selecting, adds a noise model power spectrum including a specific margin, sets the addition of the noise model power spectrum as a threshold power spectrum, and selects a frequency in which a level of an original voice power spectrum is not less than the level of the threshold power spectrum.

* * * * *